US009936787B1

(12) United States Patent
Jones

(10) Patent No.: US 9,936,787 B1
(45) Date of Patent: Apr. 10, 2018

(54) VERSATILE CORDLESS PORTABLE HAIR DRYER FOR DIRECT OR BONNET USAGE ON DEMAND

(71) Applicant: Djuna S. Jones, Memphis, TN (US)

(72) Inventor: Djuna S. Jones, Memphis, TN (US)

( * ) Notice: Subject to any disclaimer, the term of this patent is extended or adjusted under 35 U.S.C. 154(b) by 139 days.

(21) Appl. No.: 14/788,803

(22) Filed: Jul. 1, 2015

(51) Int. Cl.

| | |
|---|---|
| ***A45D 20/12*** | (2006.01) |
| ***A45D 20/18*** | (2006.01) |
| ***A45D 20/44*** | (2006.01) |
| ***A45D 20/22*** | (2006.01) |
| ***A45D 20/04*** | (2006.01) |
| *A45D 20/00* | (2006.01) |

(52) U.S. Cl.
CPC ..... *A45D 20/12* (2013.01); *A45D 20/04* (2013.01); *A45D 20/18* (2013.01); *A45D 20/22* (2013.01); *A45D 20/44* (2013.01); *A45D 20/00* (2013.01)

(58) Field of Classification Search
CPC ..... A45D 20/12; A45D 20/44; A45D 20/00; A45D 20/04; A45D 20/18; A45D 20/22; A45D 2/00
USPC ..... 34/283, 96, 97
See application file for complete search history.

(56) References Cited

U.S. PATENT DOCUMENTS

| | | | | |
|---|---|---|---|---|
| 3,073,037 A * | 1/1963 | Fay | ..... | A45D 20/18 251/212 |
| 5,884,008 A * | 3/1999 | Goldberg | ..... | A45D 20/12 206/320 |
| 6,052,915 A * | 4/2000 | Turner | ..... | A45D 20/44 34/99 |
| 2002/0144424 A1 * | 10/2002 | Vargas | ..... | A45D 20/18 34/97 |

* cited by examiner

*Primary Examiner* — Kenneth Rinehart
*Assistant Examiner* — Raymond Williamson
(74) *Attorney, Agent, or Firm* — William S. Parks

(57) ABSTRACT

A lightweight, portable hair dryer device including a rechargeable battery component and configured insulated structures to accord suitable protections for the user from excessive heating to the skin is provided. Such a hair dryer is configured to provide either a hand-held application or a flexible add-on conduit with a bonnet component. Additionally, the hair dryer device exhibits a small profile to reduce the overall size thereof for ease in handling and stowage during use and may also be outfitted with a proper attachment clip to allow for placement on a user's clothing. Coupled with an insulation portion to prevent heat transfer of deleterious levels to the user's skin during hands-free utilization thereof, the all-in-one hair dryer allows for user maneuverability and hands-free or hand-held use on demand with free movement unfettered by an electrical cord. Multiple devices for salon usage, or single personal use devices are thus available.

4 Claims, 3 Drawing Sheets

VERSATILE CORDLESS PORTABLE HAIR DRYER FOR DIRECT OR BONNET USAGE ON DEMAND

FIELD OF THE INVENTION

A lightweight, portable hair dryer device including a rechargeable battery component and configured insulated structures to accord suitable protections for the user from excessive heating to the skin is provided. Such a hair dryer is configured to provide either a hand-held direct application of heated air to a user's hair or a flexible add-on conduit with a bonnet component for placement over the user's hair. Additionally, the hair dryer device exhibits a small profile to reduce the overall size thereof for ease in handling and stowage during use and may also be outfitted with a proper attachment clip to allow for placement on a user's clothing. Coupled with the proper insulation structures noted above, the all-in-one hair dryer allows for user maneuverability and hands-free such that free movement is permitted. With a stowed handle, the direct use capability (with removal of the add-on conduit and bonnet) is permitted with the same base structure. Thus, personal use of such a device at home or even a supply of multiple and reusable hair dryers in a salon setting may be undertaken. The overall low profile hair dryer device and as well as the method of use thereof are thus encompassed within this invention.

BACKGROUND OF THE INVENTION

Hair dryers have become commonplace as daily appliances. Whether for personal use after washing one's hair, or for setting after a permanent in a salon setting, among other situations, the need to provide a heated air source to keratin fibers is standard in our everyday lives. Such devices have typically been commercialized as hand-held appliances, particularly for personal use, basically plugged into outlets and utilized for directed, heated air applications. Past hair dryers of this type typically have a dedicated handle from which a cord extends for access to an electrical outlet, as well as controls for activation and selection of air speeds and/or temperature levels (although limited to low, medium, and high as well as hot or cool). The inner components typically include a switch leading to a universal motor device that creates an airflow from an air intake that ostensibly forces air (at selected speeds, as noted above) through either a bank of metal coils or a ceramic heater that heats upon passage of electrical charge there through. The heated air generated in such a manner is then blown through a directed nozzle for controlled application to the user's hair. The user generally is accorded the ability to move around during such an exercise, limited solely by the extended cord length leading from the dryer to the electrical source.

Standard bonnet hair dryers include much of the same types of components, although such devices are commonly provided in chair or, at least, placed structures requiring a user to remain stationary during such a drying operation. Some alternative devices, however, have been developed in the prior art that allow for a user to move around freely while wearing such a dryer device with a flexible hose and bonnet attachment in place. These types of appliances, however, have been provided in large, bulky, if not cumbersome, form, requiring the user to carry such devices with back-pack-like implements, shoulder harness attachments, and/or other like limited carrying structures. Likewise, such carry articles have been provided in such large scale manners that there is little to no discussion within such teachings of the need, let alone importance, of insulating components therein for comfort and protection to the wearer. Some rechargeable (cordless) varieties of hair dryers have been taught in the past; however, such structures are noticeably, again, bulky or do not include a heating element within the dryer body (some, for instance, include heating coils within the bonnet itself). Thus, although cordless devices may generate a certain amount of heat during use from the rechargeable battery itself, such has not been taught within the prior art as a means for a heat source that may be applied to the user's hair as needed and/or desired. In other words, hair dryers have been provided in one or the other variety. A versatile, cordless, and wearable (if desired) hair dryer device that is all-encompassing and may be utilized in personal and salon settings, and may be provided as a hand-held or bonnet-type device on demand, has yet to be disclosed within the hair dryer art as of today, There thus exists a distinct need to provide an effective portable, wearable hair dryer device for these reasons. To date, as noted above, there is a lack of such appliances that allow for such desirable attributes, particularly as it pertains to the ability to accord a user the choice to utilize a hand-held device or a wearable and movable during use bonnet-type without impeding individuals' movements thereunder. The present invention, then, makes up for such deficiencies.

ADVANTAGES AND SUMMARY OF THE INVENTION

An advantage of the invention is the ability to select either a hands-free bonnet mode or a hand-held mode for drying hair without need for plugging in to an outlet. Another advantage is the ability to provide a battery-powered hair dryer with a dual clip/insulating structure for attachment to a person's clothing as well as a stowable insulating handle, both to accord protection from generated heat while the user dons the device for hands-free bonnet operation. Another advantage is the ability to provide a rechargeable device for such versatile operations.

Accordingly, the invention encompasses a portable, battery-powered hair dryer comprising: a single housing having an external surface and an internal cavity; wherein said internal cavity comprises a battery, an integrated motor and fan assembly, heat generating means, a wall portion including an insulating material therein, and an air intake aligned with said integrated motor and fan assembly; wherein said external surface comprises an attached clip assembly, a stowable handle, and at least one switch for power and temperature control of said hair dryer, wherein said clip assembly, said internal wall portion, and said stowable handle are present on a side of said hair dryer opposite that of said air intake, and wherein said hair dryer further comprises a nozzle for heated air discharge, said nozzle including means for securing a hose with a hair drying bonnet implement thereto for directed transfer of heated air to the user's hair. Additionally, such an invention further encompasses the hair dryer above wherein said battery is rechargeable either upon removal from said hair dryer or through direct connection of a charging device thereto when present within said hair dryer. Furthermore, the invention encompasses a method of drying one's hair with said hair dryer through selected utilization of said attachment clip for attachment with a user's clothing and attachment of said hose with said hair drying bonnet implement for hands-free or utilization of said stowed handle for hand-held direct drying of the user's hair, wherein said attachment clip and said stowed handle provide insulation from heat generated by said hair dryer when utilized hands-free and attached to said user's clothing.

In this manner, provided herein is a hair drying device that has versatility to be utilized away from a power outlet (no cords are needed) and, without having to modify the device in any manner (except stowage or release of the handle or removal or donning of the hose and bonnet implement), the user may select hands-free bonnet drying or hand-held direct drying of his or her hair in such a manner. In essence, the user is provided great versatility to not only maneuver throughout his or her house (or other location) while having his or her hair dried, but also the freedom to select two different types of hair drying operations in one single device. The hands-free bonnet alternative is unique in that the overall hair dryer is provided not only with the ability for clip-on attachment to a user's clothing, but also with suitable insulation provided within not only the housing (and particularly the region thereof in which the heated coils, ceramic structures, or the like, are housed), but also through the supplied attachment clip (that extends from the housing and is of a size and shape to provide a certain barrier between the housing and the user's skin, acknowledging, as well, that the user's clothing may provide a modicum of insulation, too, in such an instance) and the stowed handle (that rotates around a hinge means, for example, and that stows parallel to the hair dryer housing, potentially preferably locking into place to prevent unwanted disengagement and extension from the housing itself, providing a separate barrier between the housing and user). In an alternate, non-limiting configuration, the handle may be stowed within a recess of the housing to allow for the attachment clip to provide a level surface for suitable attachment purposes. In any event, however, such a stowed handle may be provided as an insulating material, if needed, to protect the user, just as the attachment clip accords a similar benefit.

Such a dual and versatile capability thus accords a user a hair dryer that allows for cordless operation for freedom of activity on demand. The ability to provide further hands-free capabilities (with the bonnet alternative and attachment clip, with suitable insulating results from generated heat) and hand-held operation on demand, all, again, with a cordless device, has not been provided within the industry to date. As noted above, certain hands-free bonnet dryer devices and methods have been provided, but not with a hand-held alternative that permits hands-free utilization on demand. To the contrary, it is within the art to provide hand-held hair dryers with bonnet implements attached thereto, but the user does not have the capability to place the dryer down for a hands-free operation. Furthermore, even if such a device is accorded that allows for the user to attach such prior art hand-held dryers to clothing, there is lacking a suitable insulating requirement except for the typical dryer housing design and materials. Lastly, the utilization of a cordless device as now claimed has not heretofore been provided in relation to such a potentially versatile hands-free/hand-held dryer system; in each instance, the prior art has been relegated to the necessity of corded devices, leaving the user at the mercy of power outlets. Basically, then, it should be understood that the provision of a hair dryer with insulating materials and structures integrated at a specific region thereof that would be in contact with a user's clothing (and potentially, to a certain extent, anyway, skin), particularly a housing wall portion adjacent to the heating elements of the device, the attachment clip itself, and a stowable handle (that, again, allows for hands-free utilization when stowed and hand-held operation when released). Coupled with the difficulties in developing and engineering structural placement and operation of a rechargeable battery within the body of such a device, it should be evident that the consideration and ingenuity that has been undertaken in the creation of such a device has been extensive.

To that end, then, the basic components of such a hair dryer, those that generate the heated air in a high-speed directed manner, that is, may be those typically utilized for such a purpose. Thus, an integrated fan and motor, aligned with an air intake window (with a screen to prevent significant amounts of dust, particulates, etc., from contaminating such a structure, for instance), leading to a heating element (such as, again, without limitation, coils, ceramic structures, and the like) that further leads to a discharge nozzle. The generated heated air is provided through the air intake with the fan then directing such air out through the nozzle, wherein it passes over and through the heating element (which may be adjusted on demand to a certain level, generally either a "cool," "warm," or "hot" level, as is well understood by the ordinarily skilled artisan) to generate a high speed air discharge that may be directed as needed (such as to a user's hair via hand-held operations, or, as one alternative, through an attached hose leading to a bonnet covering at least a portion of the user's hair). A switch is thus also utilized to allow for power to run such an operation, as well as possibly to allow for temperature selections (as noted above) and, additionally, fan speed levels, on demand. Such a fan and motor would be of any acceptable material and configuration for this purpose. The air intake may be of a metal or thermoplastic screen, as is typical of such dryers, as well. The dryer may also include an ion-generating component, such as those well known within the art, for selected treatment of a user's hair in such a manner. The nozzle component is configured to permit both hand-held direct utilization thereof as well as attachment (temporarily) of a bonnet implement hose for such an alternative operation. As such, as one non-limiting example, the nozzle may include indentations or other like structures that permit an elastic hose end to cover the nozzle mouth and provide a means to securely connect both together for such an activity. The housing of the dryer is preferably configured to be of a profile wherein the air intake is on the side opposite the attachment clip (and the stowed handle)(and thus, for that matter, the insulated wall portion). In this manner, the attachment clip is provided on its own side of the dryer assembly so the user may have the air intake free to activate without increased susceptibility to clothing, for instance, covering the mouth thereof (and thus potentially causing intake problems during actual utilization). As a result, the depth of the overall hair dryer measured from the air intake side to the attachment clip side is preferably less than the width thereof, ostensibly to allow for greater reliability for attachment clip viability during utilization. Were the size and weight of the overall dryer device to be too much, the clip may become easily disengaged during utilization, thereby defeating the beneficial hands-free alternative thereof. The attachment clip may be outfitted with a spring loaded (or other like) secure structure to allow for greater strength and better secure attachment purposes, if desired, as well. In any event, with the air intake configured as noted above, the aligned fan (and motor) is thus provided with the fan blades perpendicular to the plane of the air intake housing surface, thus creating a tangential (sideways, if you will) air generation. With proper air deflectors within the device, however, such a configuration provides suitable results for air speed generation purposes. Coupled with a switch that accords controls of "low" and "high" speeds in this manner, at least, the dryer accords the needed results in terms of air generation and discharge speed leading to the heating elements therein. Such heating elements are, as noted above, of any typical structure, as long as the overall temperatures generated are suitable for hair drying purposes. Thus, nichrome, copper, etc., coils, ceramic heaters, and the like, would be suitable.

As noted above, then, the inventive hair dryer device includes a wall portion within the housing, located adjacent to the heating element components and within the housing wall on the side on which the attachment clip is present. Such a wall portion is provided either as a single monolith or with a coating, or like extra structure, to the internal or external surface thereof, and including a suitable material to insulate the user's skin and/or clothing from excessive heat generated by the heating elements during operation. Thus, for instance, thickened polacrylate, polyurethane, regions within the wall portion, as well as possibly foam inserts therein exhibiting high heat dissipation levels, would be potentially preferred for this purpose. The wall portion is preferably the entirety of that side of the hair dryer, but with the addition of the attachment clip and the stowed handle thereon, such may be limited to just the region not in contact with such other implements. With the attachment clip, then, exhibiting increased insulation levels, either with thickened plastic or foam embedded materials with resilient plastic outer edges, as examples, as well as the same possible materials utilized within the stowed handle, the user is properly protected from heat generated not only by the heating elements, but also the battery and the fan and motor, too, during operation. The attachment clip thus typically will extend from one edge of the housing side on which it is positioned to the other edge and extending at least one-third of the length of such a side, as well, all in order to accord sufficient resilience for attachment to a user's clothing (and to also withstand the forces applied due to the device weight, as well, when utilized in such a manner). The stowed handle may thus be of a shape that covers the entirety of the attachment clip side of the hair dryer device, if desired. In such a manner, the handle itself may be squared, curved (inwardly or outwardly), in an I-shape, or basically any other possible shape, in accordance with the comfort of the user while utilizing such in hand-held mode. As alluded to above, in stowed fashion, the handle may be secured in a temporarily locked manner within or on the surface of the housing (such as through a pressure clip at the surface or within the hinge assembly, through magnets within the handle and the housing, and the like). When released, the handle would thus rotate around the hinge to a fully extended position roughly perpendicular to its stowed position (though less or more than such an angle may be undertaken, if desired, as long as the unstowed handle is provided in a manner that allows the user to comfortably hold and maneuver the dryer as needed for hand-held drying purposes.

The battery is provided within a proper compartment within the housing, preferably at a location at the end opposite the nozzle, and adjacent the power, etc., switch assembly. The weight of the battery is important to accord a suitable dryer for clip-on purposes (hands-free bonnet drying). If the battery is too heavy, the ability to, again, attach and secure the device to the user/wearer would be potentially compromised (at least in terms of comfort and freedom of movement permitted). Thus, a rechargeable battery that is, at most, about 8 ounces in weight, and accords a minimum of about 1-2 hours of operation without needing recharging, would be potentially preferred. The size and shape of such a battery may be of any suitable configuration for this purpose, as well. Thus Nickel cadmium types are potentially preferred, with the potential for Lithium ion batteries, as well, although the power generation capability is generally higher with the nickel cadmium types. The battery compartment (and thus the connections with the power source) may be configured, as well, to comply with certain interchangeable battery devices with other types of powered devices, if desired, too. Such a rechargeable battery may thus be removed from the device for such a purpose, or, alternatively, may be connected from an external power source for recharge. The ordinarily skilled artisan would well understand such a type of battery in this manner.

The bonnet implement (and hose connection) may be of any typical articles of such a type. As long as the hose allows for connection on the dryer nozzle and connection, as well, with the bonnet implement when placed over the user's hair, and, furthermore, can withstand the heated air temperatures (and possible high air discharge speeds) without disengaging, disintegrating, etc., during utilization, then such would be appropriate. Likewise, the bonnet implement must also meet such criteria for utilization lest the overall device fail upon actual operation, clearly not an aim or desire herein.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The advantages of the disclosure, along with the various features of novelty which characterize the disclosure, are pointed out with particularity in the claims annexed to and forming a part of this invention disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE DRAWINGS AND PREFERRED EMBODIMENTS

With reference now to the drawings, and in particular to FIGS. 1 through 5 thereof, a new portable, versatile hair dryer embodying the principles and concepts of the invention, without any limitation of breadth of the overall invention intended.

Figure 1:
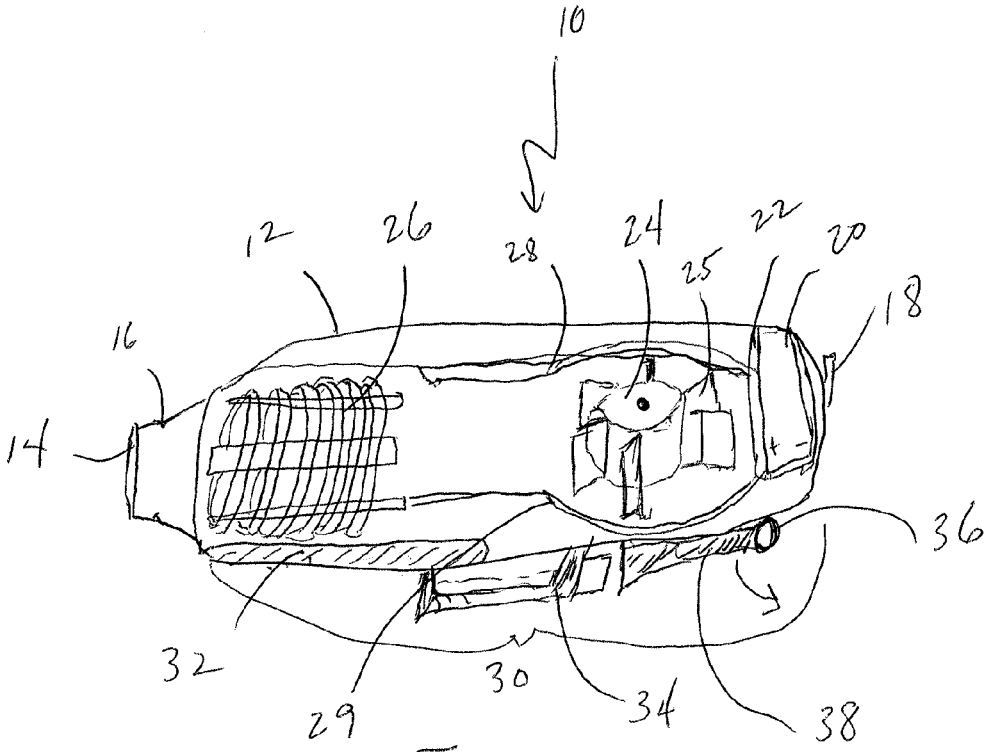
FIG. 1 is a side perspective cut-away view of one potentially preferred embodiment of a versatile hair dryer device.

FIG. 1 presents a side perspective cut-away view of one potentially preferred configuration of an inventive cordless hair dryer 10 that provides dual capability of hands-free and hand-held operation. The dryer 10 includes a housing 12 within which are situated heating elements 26, a fan and motor 24 with fan blades 25, air deflection panels 28, 29, a battery compartment 22, and rechargeable battery 20. The housing 12 further includes, externally, a heated air discharge nozzle 14 with hose attachment indentations 16, and a switch 18 for control of power, at least (in conjunction, for instance, with the battery 20). Such a battery 20 may be removed from the compartment 22 for recharging, or, alternatively, a power source may be attached through a port (not illustrated), as one example, for such a purpose. The dryer 10 further includes an attachment side 30 that includes an attachment clip 34 that permits secure placement of the dryer 10 over, for instance, a pants waistband (such as 54 in FIG. 3), a belt, etc., on demand. The attachment side 30 also includes a housing wall portion 32 that includes extra insulating material to alleviate the heat transferred from the heating elements 26 outwardly through the housing 12, thus protecting a user (such as 50 in FIG. 3) from such generated heat while wearing such a dryer 10. Additionally, the attachment side 30 includes a stowable handle 38 attached thereto the side 30 through a rotating hinge 36. Such a handle 38 accords insulating properties, as well, for the user (such as 50 in FIG. 3) from any heat generated within the housing 12 (such as by the fan and motor 24, for instance, in addition to the heating elements) when utilized in hands-free mode (FIG. 3).

Figure 2:
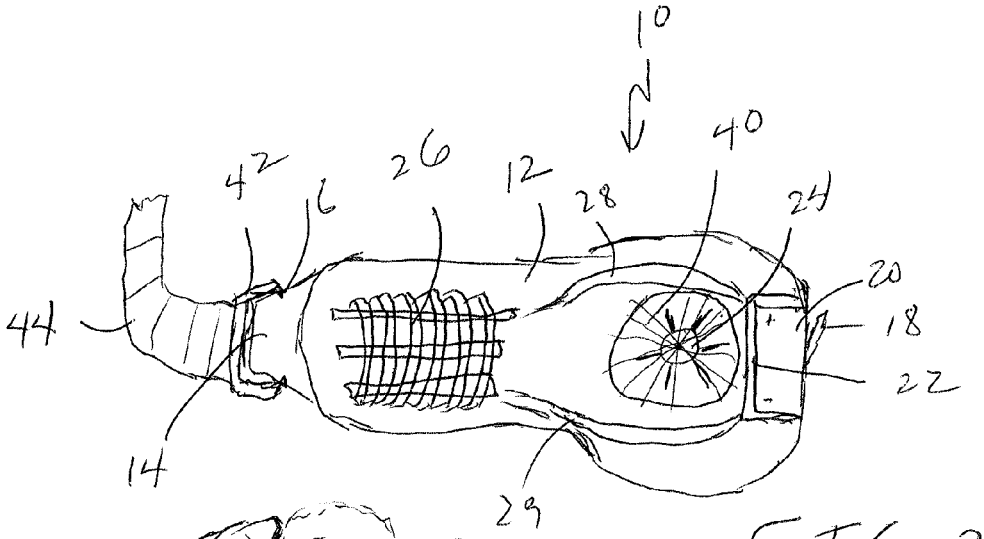
FIG. 2 is a top perspective cut-away view of the hair dryer device with a hose attachment.
Figure 3:
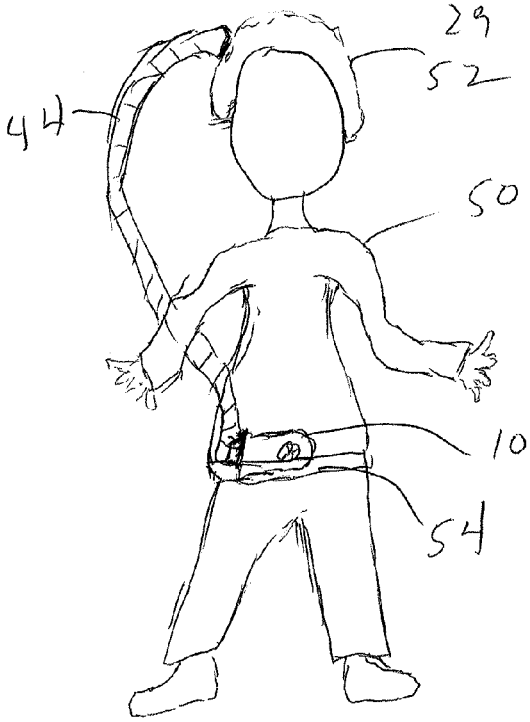
FIG. 3 is a side perspective view of a hands-free bonnet utilization of the inventive hair dryer of FIG. 2.

FIGS. 2 and 3 thus provide views of the same dryer 10 with a hose 44 attached through a connecting elastic opening 42 around the nozzle indentations 16. The attachment of the dryer 10 to a waistband 54 of the clothing of a user 50, allows for hands-free movement (particularly within a cord needed for power supply capability). The hose 44 leads to a bonnet 52 that covers at least a portion of the user's hair (such as 56 of FIG. 5). In this manner, again, the user is free to move about the location and with his or her hands completely free for other activities while his or her hair is drying under the bonnet 52, all while being suitably protected from excessive heat generated thereby by the attachment side (30 of FIG. 1) insulating components (wall portion 32, attachment clip 34 and stowed handle 36). Additionally, an air intake 40 is provided over the fan 24 to permit air to enter and be forced through heating elements (26 of FIG. 1).

Figure 4:
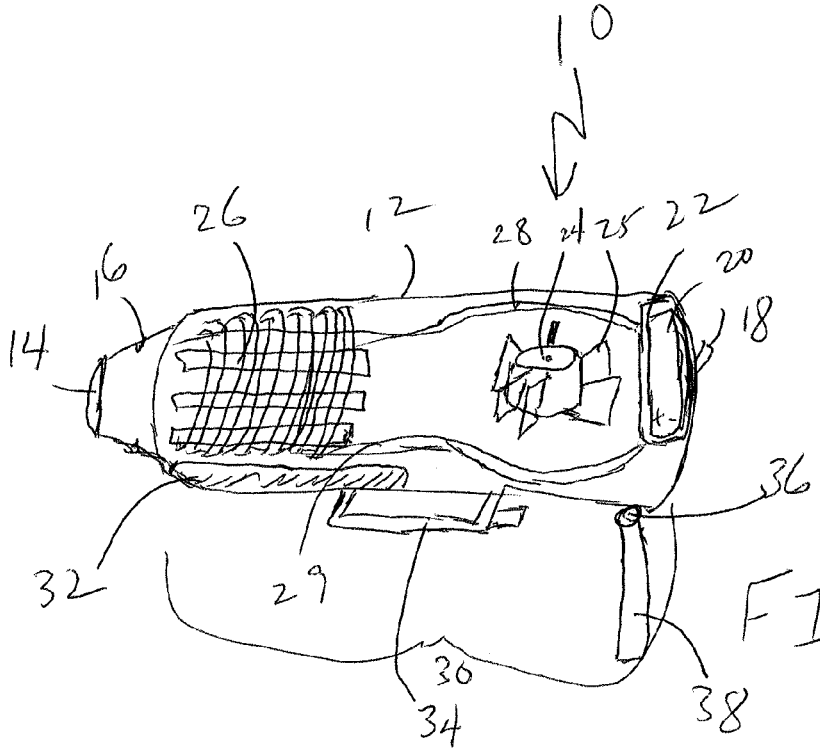
FIG. 4 is a side perspective cut-away view of the hair dryer of FIG. 1 with the handle released from a stowed position.
Figure 5:
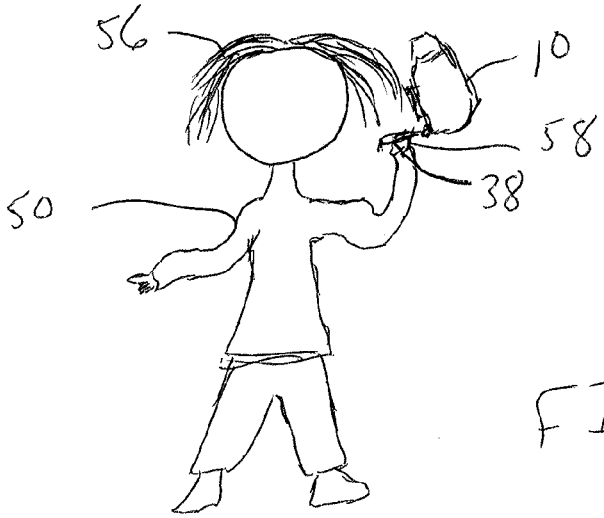
FIG. 5 is a side perspective view of a hand-held utilization of the inventive hair dryer of FIG. 4.

The versatility of the inventive dryer 10 is further shown in FIGS. 4 and 5 as the handle 38 is shown in unstowed position, allowing the user 50 to ability to not only utilize such a handle 38 in his or her hand 58 to dry his or her hair 56, but also with the freedom to maneuver around his or her location without being limited by power a needed power cord.

Such a hair dryer device may thus be supplied for personal use at a person's home (or to be taken to different locations, as desired), or one or more may be provided in a salon setting allowing for customers free movement and avoidance of stationary "helmet" drying machines while undergoing a suitable hair drying treatment step.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A portable, battery-powered hair dryer comprising: a single housing having an external surface and an internal cavity; wherein said internal cavity comprises a battery, an integrated motor and fan assembly, heat generating means, and a wall portion including an insulating material therein; wherein said dryer further comprises an air intake aligned with said integrated motor and fan assembly; wherein said external surface comprises an attached clip assembly, a stowable handle, and at least one switch for power and temperature control of said hair dryer; wherein said clip assembly, said internal cavity wall portion, and said stowable handle are present on a side of said hair dryer opposite that of said air intake and provide insulation on such a hair dryer side from heat generated by said heat generating means; and wherein said hair dryer further comprises a nozzle for heated air discharge, said nozzle attachable to a hose with a hair drying bonnet implement for directed transfer of heated air through said bonnet and also usable without said hose and bonnet for directed transfer of heated air with said handle in an unstowed position.

2. The hair dryer of claim 1 wherein said battery is rechargeable either upon removal from said hair dryer or through direct connection of a charging device thereto when present within said hair dryer.

3. A method of drying a user's hair with said hair dryer of claim 1, said method comprising selecting a first operation mode or a second operation mode, wherein said first operation mode includes attaching said attachment clip to said user's clothing and attachment of said hose with said hair drying bonnet implement to said nozzle for hands-free operation thereof; wherein said attachment clip, insulating material within said internal cavity wall, and said stowed handle all provide insulation from heat generated by said hair dryer in said hands-free operation; wherein the second operation mode includes utilizing said nozzle without any hose and bonnet attached thereto, unstowing said handle for hand-held operation.

4. The method of claim 3 wherein said battery of said hair dryer is rechargeable either upon removal from said hair dryer or through direct connection of a charging device thereto when present within said hair dryer.

* * * * *